US008277011B2

(12) United States Patent
Suzuki

(10) Patent No.: US 8,277,011 B2
(45) Date of Patent: Oct. 2, 2012

(54) LIQUID EJECTING HEAD UNIT AND LIQUID EJECTING APPARATUS

(75) Inventor: Shigeki Suzuki, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 283 days.

(21) Appl. No.: 12/703,580

(22) Filed: Feb. 10, 2010

(65) Prior Publication Data

US 2010/0225694 A1 Sep. 9, 2010

(30) Foreign Application Priority Data

Mar. 3, 2009 (JP) ..... 2009-049904

(51) Int. Cl.
*B41J 29/38* (2006.01)

(52) U.S. Cl. ..... 347/14; 347/20

(58) Field of Classification Search ..... 347/14, 347/20

See application file for complete search history.

(56) References Cited

U.S. PATENT DOCUMENTS

| | | | | |
|---|---|---|---|---|
| 7,585,046 | B2 | 9/2009 | Miyata | |
| 2006/0221116 | A1 * | 10/2006 | Miyata | 347/20 |
| 2008/0136880 | A1 * | 6/2008 | Tajima | 347/87 |

FOREIGN PATENT DOCUMENTS

| | | |
|---|---|---|
| JP | 2006-231678 | 9/2006 |

* cited by examiner

*Primary Examiner* — Laura Martin
(74) *Attorney, Agent, or Firm* — Workman Nydegger

(57) ABSTRACT

A liquid ejecting head unit includes: a liquid ejecting head which includes a nozzle row formed by nozzles arranged in series so as to eject a liquid onto a printing medium; and a base plate which retains the liquid ejecting head, wherein a linear expansion coefficient of the base plate in a first direction as a relative moving direction between the printing medium and the liquid ejecting head is larger than that in a second direction perpendicular to the first direction.

7 Claims, 9 Drawing Sheets

LIQUID EJECTING HEAD UNIT AND LIQUID EJECTING APPARATUS

BACKGROUND

1. Technical Field

The present invention relates to a liquid ejecting head unit and a liquid ejecting apparatus, and particularly, to an ink jet printing head unit and an ink jet printing apparatus which ejects ink as a liquid.

2. Related Art

A liquid ejecting apparatus which is represented by an ink jet printing apparatus such as an ink jet printer or a plotter includes a liquid ejecting head unit (hereinafter, referred to as a head unit) having plural liquid ejecting heads capable of ejecting a liquid such as ink stored in a cartridge or a tank in the form of a liquid droplet.

The plural liquid ejecting heads constituting the liquid ejecting head unit are highly precisely positioned and fixed to predetermined positions of a base plate as a common retaining member. That is, each of the liquid ejecting heads is fixed to the base plate while each nozzle is highly precisely positioned thereto. For example, each of the liquid ejecting heads is fixed to the base plate while the nozzles are highly precisely positioned thereto at the same pitch in a direction along a nozzle row formed by arranging in series plural nozzles of each of the liquid ejecting heads (for example, see JP-A-2006-231678).

However, since the base plate is expanded due to a variation in temperature of the head unit in use, each nozzle row of each liquid ejecting head is deviated from a desired predetermined arrangement position. Likewise, since the nozzle row is deviated from the desired predetermined arrangement position, a landing position where an ink droplet is landed on a printing medium such as a paper sheet is deviated, and hence a problem arises in that the printing quality deteriorates.

In addition, the problem exists in a liquid ejecting head unit for ejecting a liquid other than ink as well as the ink jet printing head unit.

SUMMARY

An advantage of some aspects of the invention is that it provides a liquid ejecting head unit and a liquid ejecting apparatus capable of preventing a deterioration in the precision of a liquid droplet landing position.

In order to achieve the above-described object, according to an aspect of the invention, there is provided a liquid ejecting head unit including: a liquid ejecting head which includes a nozzle row formed by nozzles arranged in series so as to eject a liquid onto a printing medium; and a base plate which retains the liquid ejecting head, wherein a linear expansion coefficient of the base plate in a first direction as a relative moving direction between the printing medium and the liquid ejecting head is larger than that in a second direction perpendicular to the first direction.

With the above-described configuration, even when the base plate is expanded due to a variation in temperature of the base plate in use, since the base plate is hardly expanded or contracted or is expanded or contracted by an ignorable amount in the second direction, it is possible to reduce an error of the precision of the liquid droplet landing position in the second direction. In addition, since the base plate is expanded in the first direction rather than the second direction, even when the liquid droplet landing position is deviated due to the expansion thereof, it is possible to correct the liquid droplet landing position in the first direction just by correcting the liquid ejection timing at which a liquid is ejected from the liquid ejecting head. Accordingly, it is possible to improve the precision of the liquid droplet landing position with the expansion of the base plate.

Here, a regulation member may include regulation portions facing side surfaces of both ends of the base plate in the second direction and regulates expansion of the base plate in the second direction. Accordingly, the expansion of the base plate in the second direction is regulated by the regulation portion, and the base plate is substantially expanded only in the first direction. For this reason, it is possible to further reduce an error in the liquid droplet landing position in the second direction. In addition, it is possible to reliably correct the liquid droplet landing position by adjusting the liquid ejection timing at which the liquid is ejected from the liquid ejecting head.

In addition, the regulation member may include a sandwiching portion which sandwiches the base plate in a liquid ejection direction of the liquid ejecting head, and regulates expansion of the base plate in the liquid ejection direction. Accordingly, since the expansion of the base plate in the ink ejection direction is regulated by the sandwiching portion, it is possible to further allow the base plate to be substantially expanded only in the first direction. For this reason, it is possible to further reduce the deviation of the liquid droplet landing position in the second direction. In addition, it is possible to more reliably correct the liquid droplet landing position by adjusting the liquid ejection timing at which the liquid is ejected from the liquid ejecting head.

Further, a plurality of the liquid ejecting heads may be disposed in one base plate. Accordingly, in the positional deviation of each liquid ejecting head caused by the expansion of the base plate, all the liquid ejecting heads have the same positional deviation. For this reason, at the time when the liquid droplet landing position is corrected by adjusting the liquid ejection timing, it is possible to simultaneously adjust the liquid ejection timing of all liquid ejecting heads.

According to another aspect of the invention, there is provided a liquid ejecting apparatus including: the liquid ejecting head unit; a moving mechanism which relatively moves the liquid ejecting head unit and the printing medium in the first direction; a controller which transmits a driving signal to the liquid ejecting head so as to eject a liquid therefrom; and an apparatus body.

With the above-described configuration, even when the base plate is expanded due to a variation in temperature of the base plate in use, since the base plate is hardly expanded or contracted or is expanded or contracted by an ignorable amount in the second direction, it is possible to reduce an error of the precision of the liquid droplet landing position in the second direction. In addition, since the base plate is expanded in the first direction rather than the second direction, even when the liquid droplet landing position is deviated due to the expansion thereof, it is possible to correct the liquid droplet landing position in the first direction just by correcting the liquid ejection timing at which a liquid is ejected from the liquid ejecting head. Accordingly, it is possible to improve the precision of the liquid droplet landing position with the expansion of the base plate.

In addition, the liquid ejecting head unit may be fixed to the apparatus body, and the moving mechanism may transport the printing medium to the liquid ejecting head unit along the first direction. Accordingly, it is possible to provide a so-called line printing apparatus having an excellent liquid ejecting performance.

Further, the liquid ejecting head unit may be provided in the apparatus body so as to be movable in the first direction, and the moving mechanism may transport the printing medium to the liquid ejecting head unit along the second direction. Accordingly, it is possible to provide a so-called serial printing apparatus having an excellent liquid ejecting performance.

Furthermore, a temperature measuring unit may be provided which measures a temperature of the base plate. The controller may correct a liquid droplet ejection timing on the basis of the temperature measured by the temperature measuring unit, and may transmit the driving signal to the liquid ejecting head at the corrected liquid droplet ejecting timing. Accordingly, it is possible to precisely correct the liquid ejection timing on the basis of the temperature of the base plate.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, exemplary embodiments of the invention will be described in detail.

First Embodiment

Figure 1:
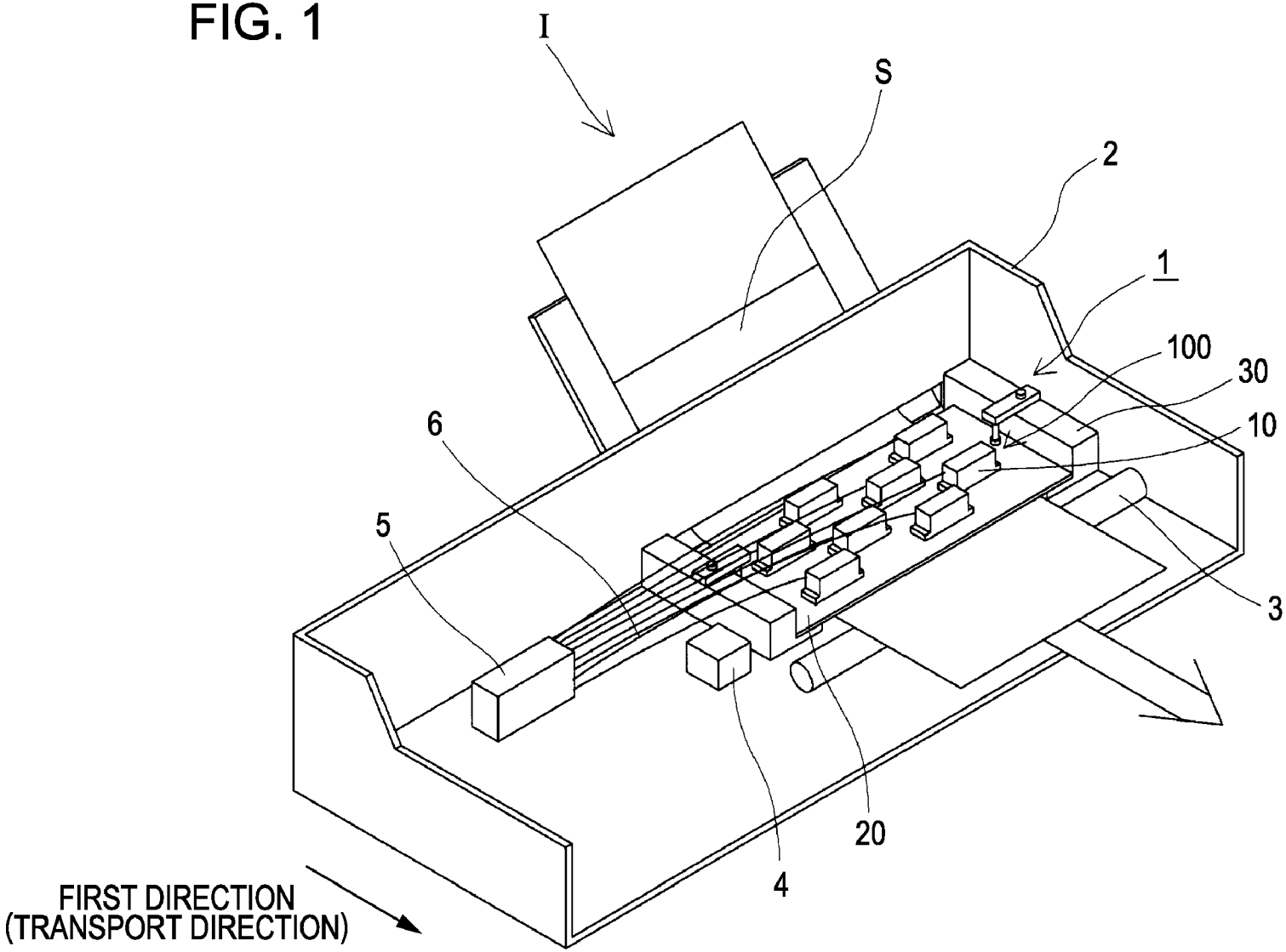
FIG. 1 is a schematic perspective view illustrating an ink jet printing apparatus according to a first embodiment.
Figure 2:
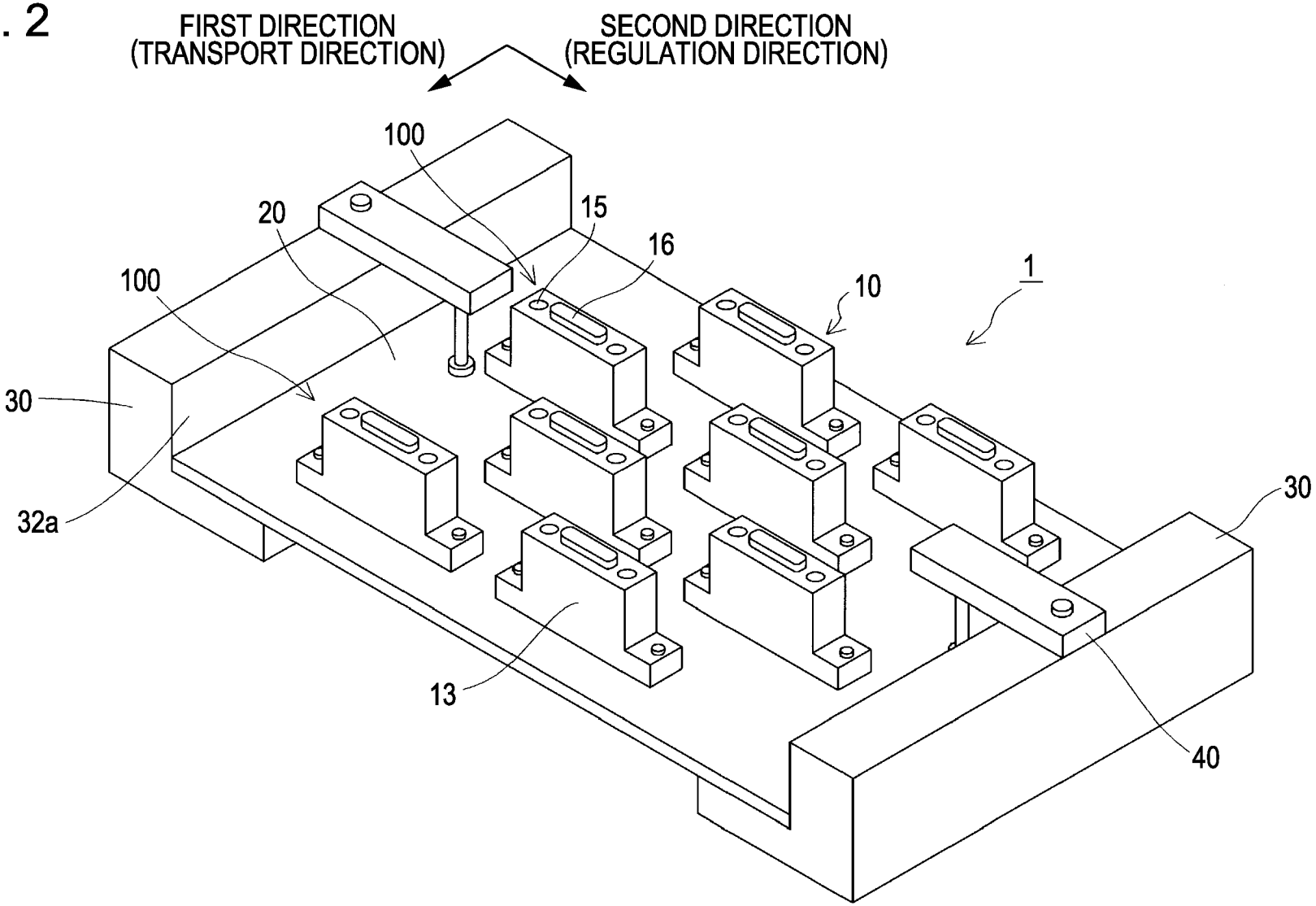
FIG. 2 is a perspective view illustrating an ink jet printing head unit according to the first embodiment.
Figure 3:
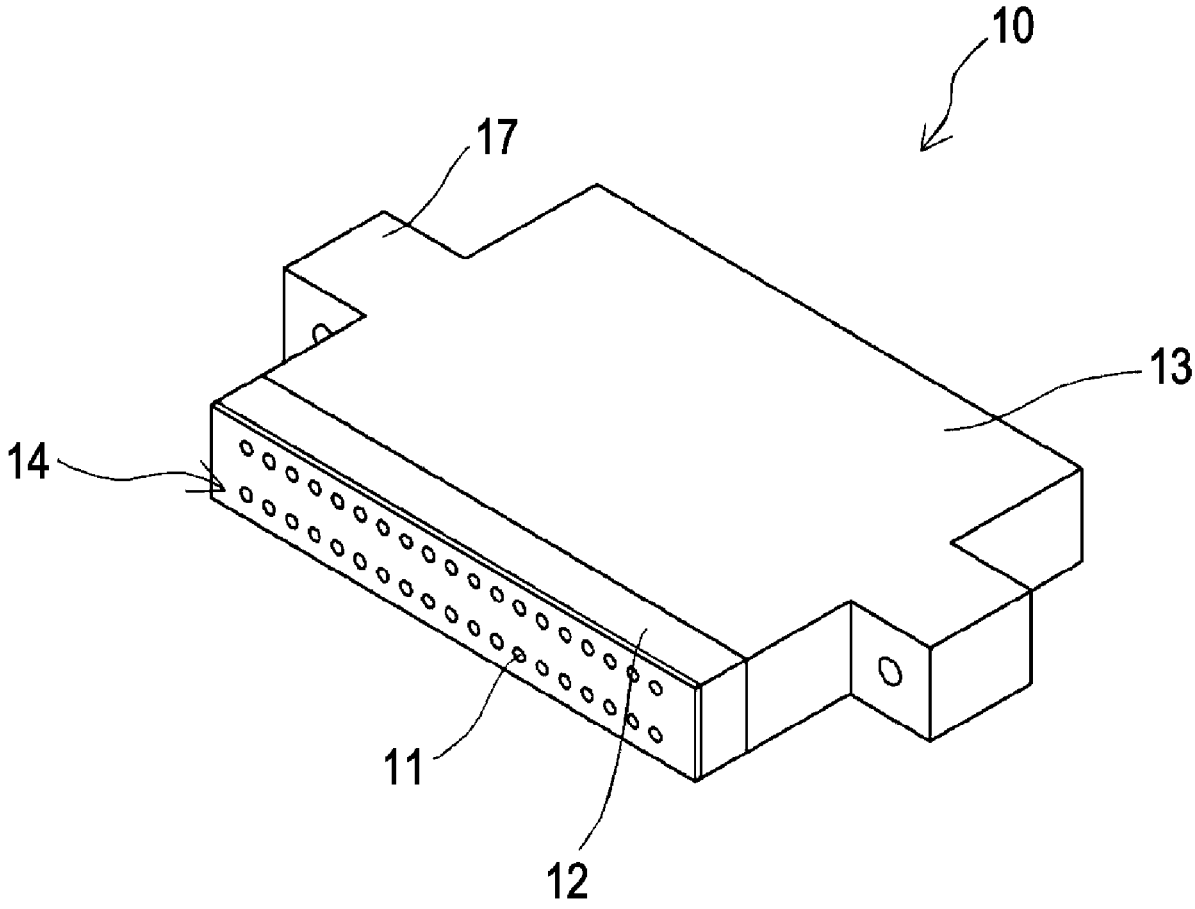
FIG. 3 is a schematic perspective view illustrating the ink jet printing head unit according to the first embodiment.
Figure 4:
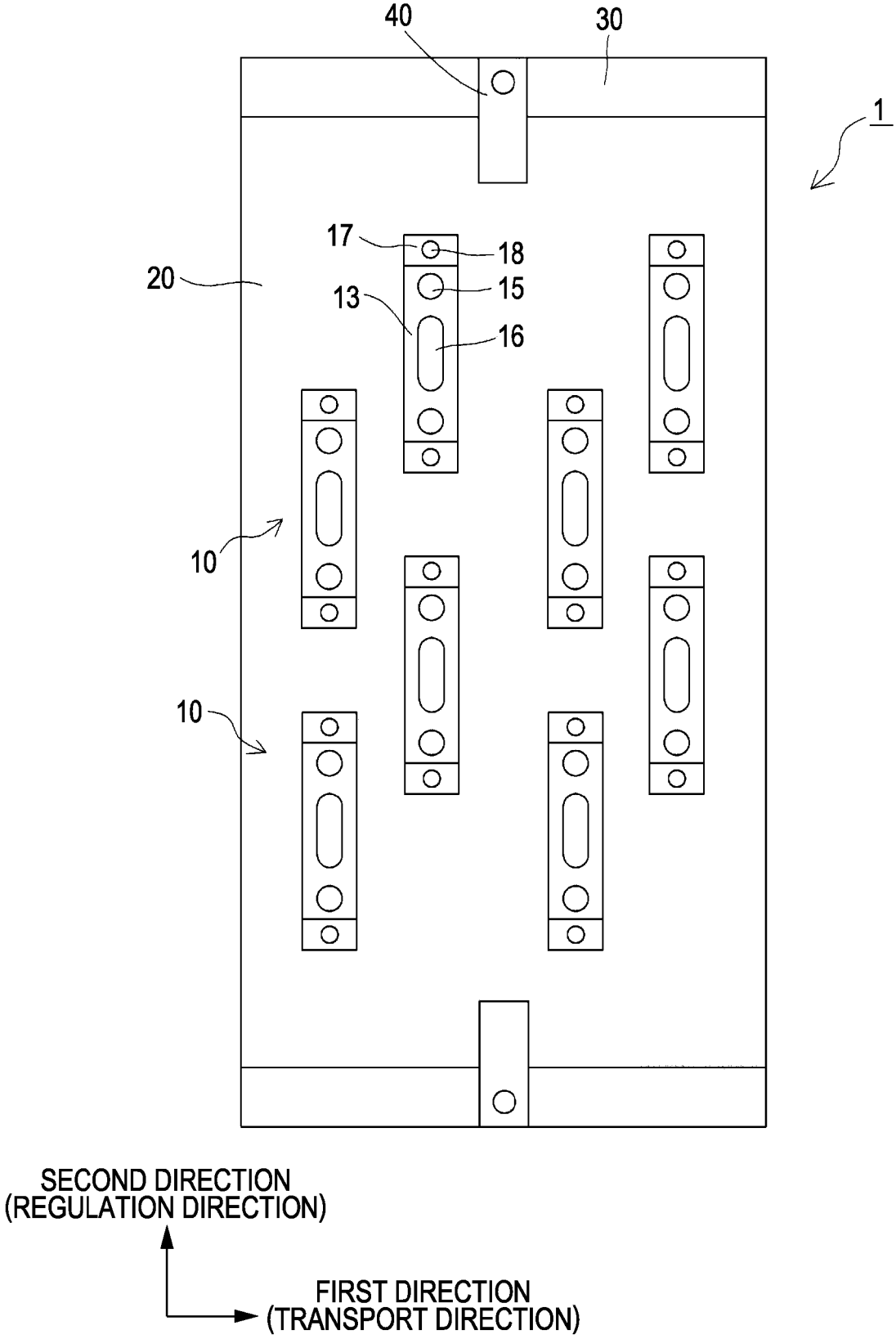
FIG. 4 is a plan view illustrating the ink jet printing head unit according to the first embodiment.
Figure 5:
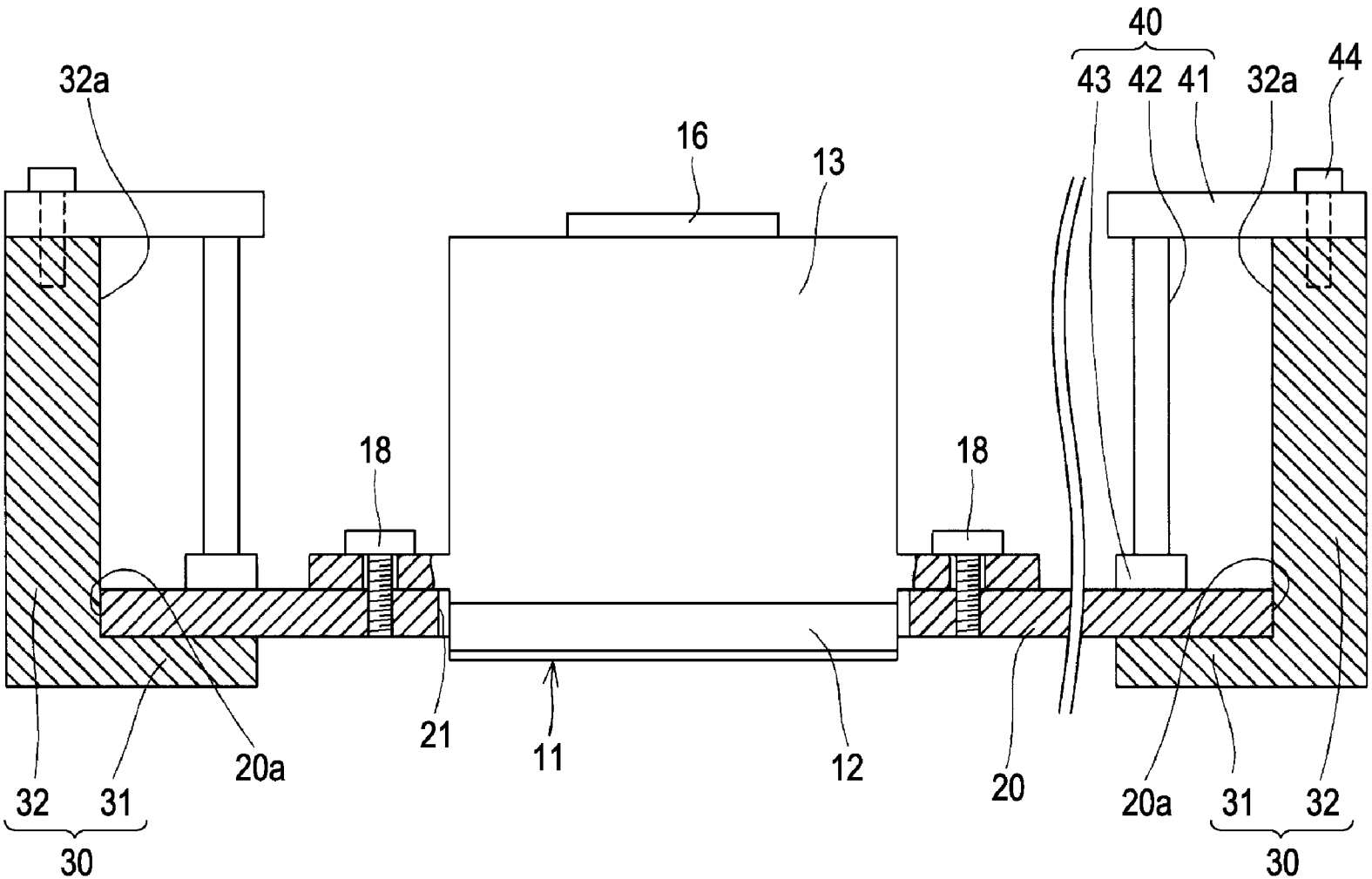
FIG. 5 is a sectional view illustrating the ink jet printing head unit according to the first embodiment.

As shown in FIG. 1, in this embodiment, an ink jet printing apparatus I includes an ink jet printing head unit 1 (hereinafter, referred to as a head unit 1) which is an example of a liquid ejecting head unit, an apparatus body 2, a sheet feeding roller 3 which is an example of a moving mechanism, and a controller 4.

The head unit 1 includes a base plate 20 which retains plural ink jet printing heads 10 (hereinafter, referred to as heads 10) and frame members 30, each of which is an example of a regulation member attached to the base plate 20. The head unit 1 is fixed to the apparatus body 2 through the frame members 30.

In addition, the sheet feeding roller 3 is provided in the apparatus body 2. The sheet feeding roller 3 transports a printing sheet S (printing medium) such as a paper sheet fed to the apparatus body 2 in a first direction, and allows the printing sheet S to pass through a position close to ink ejection surfaces of the heads 10. Here, the first direction indicates a relative moving direction between the printing sheet S and the heads 10. In this embodiment, since the head unit 1 is fixed to the apparatus body 2, the first direction corresponds to a direction in which the printing sheet S is transported by the sheet feeding roller 3. Hereinafter, the first direction will be referred to as a transport direction.

In addition, the apparatus body 2 is provided with an ink storage member 5 which stores ink therein, and the ink is supplied to each of the heads 10 through a supply tube 6.

Although it is described later in detail, on the basis of the image printed on the printing sheet S, the controller 4 transmits a signal to the sheet feeding roller 3 so as to transport the printing sheet S by transmitting, and transmits a driving signal to each of the heads 10 through a wiring (not shown) so as to eject ink.

In the ink jet printing apparatus I, the printing sheet S is transported in the transport direction by the sheet feeding roller 3, and the ink is ejected from the head 10 of the head unit 1 so as to print an image or the like on the printing sheet S.

As shown in FIGS. 2 to 5, the head unit 1 according to this embodiment includes the plural heads 10 and the base plate 20 in which the plural heads 10 are positioned and fixed to predetermined positions.

Each of the heads 10 includes a head body 12 of which one end surface has plural nozzles 11, and a head casing 13 which is fixed to the surface of the head body 12 on the opposite side of the nozzles 11. For example, in this embodiment, the head body 12 has two rows of nozzle rows 14 in which the nozzles 11 are arranged in series. In addition, although it is not shown in the drawing, the inside of the head body 12 is provided with a pressure generating chamber which forms a part of passageways communicating with the nozzles 11, and a pressure generating member which generates a pressure variation in the pressure generating chamber so as to eject ink from the nozzles.

An example of the pressure generating member is not particularly limited. For example, a piezoelectric element having a piezoelectric material exhibiting an electromechanical conversion function interposed between two electrodes may be used, a heating element may be disposed in the pressure generating chamber so as to eject liquid droplets from the nozzles 11 by using bubbles generated by heat of the heating element, or static electricity may be generated between a vibration plate and an electrode so that the vibration plate is deformed by the electrostatic force and liquid droplets are ejected from the nozzles 11. In addition, as the piezoelectric element, a bending-vibration-type piezoelectric element in which a lower electrode, a piezoelectric material, and an upper electrode are laminated from the pressure generating chamber and are bent or a vertical-vibration-type piezoelectric element in which a piezoelectric material and an electrode forming material are alternatively laminated and are expanded or contracted in the axial direction may be used.

The head casing 13 includes a supply path 15 which is used to supply the ink stored in the ink storage member 5 (see FIG. 1) such as an ink tank to the head body 12. In addition, in the inside of the head casing 13, a driving wiring (not shown) connected to the above-described piezoelectric element or the like is accommodated, and the surface of the head casing 13 on the opposite side of the head body 12 is provided with a connector 16 connected to the driving wiring.

The head 10 is inserted through a perforation hole 21 provided in the base plate 20, and a flange portion 17 provided in the outer periphery of the head casing 13 is fixed to one surface of the base plate 20 through fixed screws 18. Hereinafter, the one surface of the base plate 20 to which the flange portion 17 is fixed will be referred to as a retaining surface, and the surface opposite to the retaining surface, that is, the surface of the base plate 20 on the side of the nozzle rows 14 will be referred to as an ejection surface.

In this embodiment, for example, a head group 100 is configured in such a manner that plural, for example, two heads 10 are arranged along the nozzle rows 14 formed by the nozzles 11 arranged in series. Four head groups 100 are disposed on the base plate 20 so as to be parallel in a direction perpendicular to the nozzle rows 14. Each of the heads 10 is disposed on the base plate 20 so that the nozzle rows 14 are perpendicular to the transport direction. In addition, the plural heads 10 constituting the head groups 100 are arranged in a zigzag shape, and the plural heads 10 are arranged so that all nozzles 11 are arranged at the same pitch along the nozzle rows 14.

A linear expansion coefficient of the base plate 20 in the regulation direction (second direction) perpendicular to the transport direction is smaller than that in the transport direction (first direction) which is a moving direction of the printing sheet S with respect to the head 10. That is, the base plate 20 is expanded due to a variation in environmental temperature, but the expansion amount caused by the expansion in the transport direction is larger than that in the regulation direction.

In addition, as a material of the base plate 20, ceramic, glass, or alumina may be used. Further, since a laminate material of graphite and alumina has a characteristic in which the expansion in the planar direction is difficult and the expansion in the vertical direction perpendicular to the planar direction is easy, the laminate material has an anisotropic linear expansion coefficient. Accordingly, the base plate 20 may be formed of the laminate material.

Each of the frame members 30 includes a base portion 31 which retains the ejection surface of the base plate 20 and a regulation portion 32 which is formed upright from the base portion 31. The regulation portions 32 face side surfaces 20*a* of both ends of the base plate 20 in the regulation direction (second direction). In this embodiment, two frame members 30 are installed, and a regulation surface 32*a* of each of the regulation portions 32 on the side of the base plate 20 comes into contact with the side surface 20*a*.

Likewise, since the regulation surfaces 32*a* of the regulation portions 32 respectively come into contact with the side surfaces 20*a* of both ends of the base plate 20 in the regulation direction, the expansion of the base plate 20 in the regulation direction is regulated. By means of the regulation of the regulation portions 32, the base plate 20 is expanded in the transport direction. Here, as described above, since the linear expansion coefficient of the base plate 20 in the regulation direction is smaller than that in the transport direction, the base plate 20 is slightly expanded in the regulation direction, but the slight expansion is regulated by the regulation portion 32. Accordingly, the base plate 20 is substantially expanded only in the transport direction.

In addition, the regulation portions 32 may not always come into contact with the side surfaces 20*a* of the base plate 20, and a slight gap may be formed between the regulation surface 32*a* of the regulation portion 32 and the side surface 20*a* of the base plate 20. This is because the regulation surface 32*a* comes into contact with the side surface 20*a* so as to regulate the further expansion of the base plate 20 in the regulation direction when the base plate 20 is slightly expanded in the regulation direction.

Further, the frame member 30 includes a sandwiching portion 40 which sandwiches the base plate 20 in an ink ejection direction of the head 10. In detail, the sandwiching portion 40 includes a crossbeam portion 41 which is provided in the regulation portion 32 of the frame member 30, a bridge portion 42 which is provided in the crossbeam portion 41, and a contact portion 43 which is provided in the bridge portion 42 and comes into contact with the base plate 20.

The contact portion 43 of the sandwiching portion 40 comes into contact with the retaining surface of the base plate 20. The crossbeam portion 41 is fixed to the regulation portion 32 by a fixed screw 44, and the base plate 20 is sandwiched between the contact portion 43 of the sandwiching portion 40 and the base portion 31 of the frame member 30.

Likewise, since the sandwiching portion 40 sandwiches the base plate 20, the expansion of the base plate 20 is regulated in the ink ejection direction (a direction perpendicular to the transport direction and the regulation direction) of the head 10. Here, as described above, since the expansion of the base plate 20 is regulated in the regulation direction by the regulation portion 32, the base plate 20 is further expanded in the transport direction in accordance with the expansion regulation in the ink ejection direction.

As described above, in the head unit 1, even when the base plate 20 is expanded with a variation in environmental temperature, the base plate 20 is hardly expanded or contracted or is expanded or contracted by an ignorable amount in the regulation direction. Accordingly, it is possible to reduce an error in the precision upon allowing ink droplets to be landed in the regulation direction.

Figure 6:
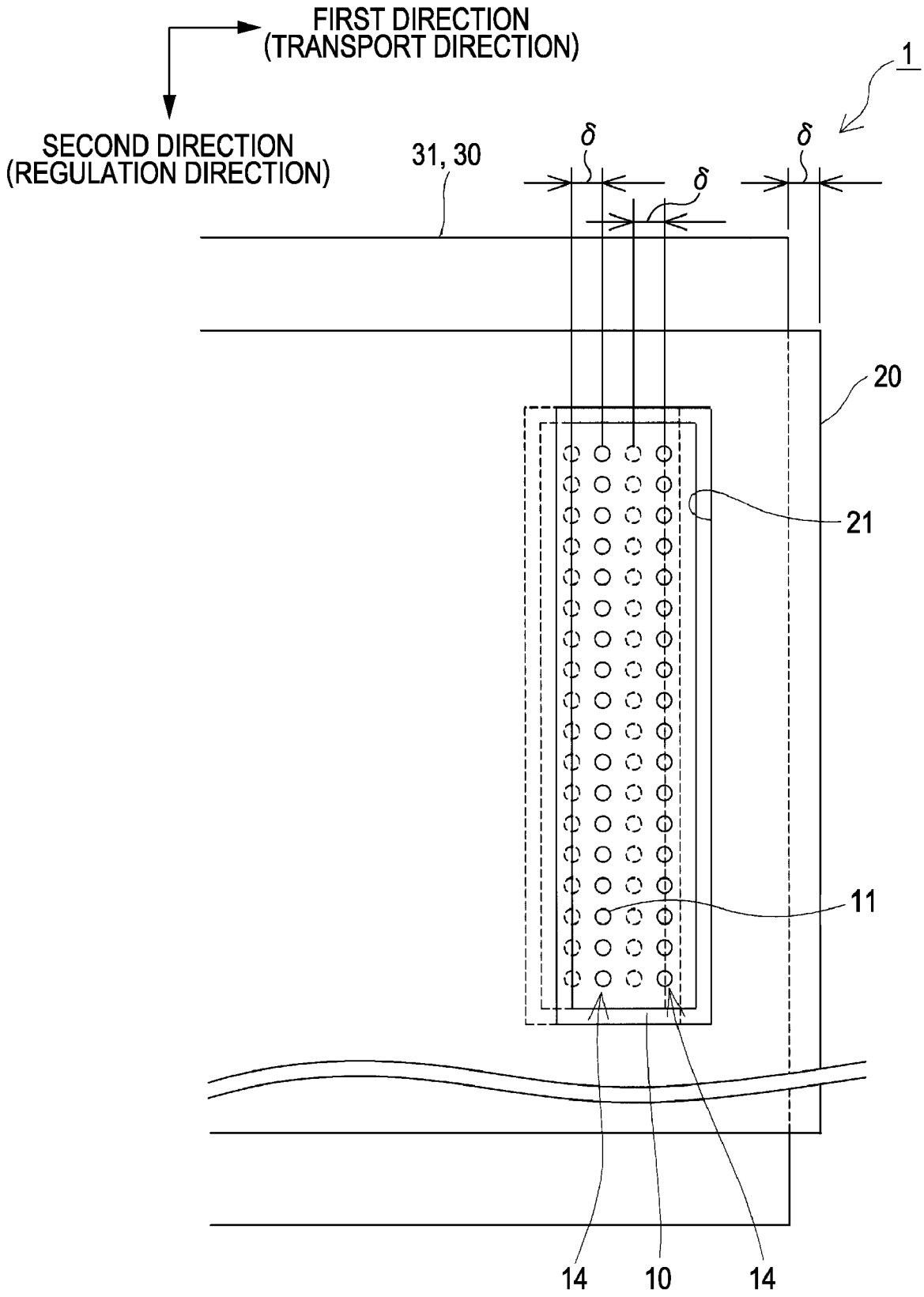
FIG. 6 is a plan view illustrating the ink jet printing head unit according to the first embodiment.

Meanwhile, since the base plate 20 is adapted to be substantially expanded in the transport direction, even when the ink droplet landing position is deviated due to the expansion, the ink droplet is landed on an extension line extending from a desired ink droplet landing position along the transport direction. For example, as shown in FIG. 6, the base plate 20 is expanded by an expansion amount δ in the transport direction. Likewise, when the base plate 20 is expanded by the expansion amount δ in the transport direction, the nozzle rows 14 and the heads 10 retained by the base plate 20 are deviated by the expansion amount δ from the desired predetermined arrangement positions. The ink ejected from the nozzle rows 14 is landed on the printing sheet S while being deviated by the expansion amount δ from the desired ink droplet landing position in the transport direction.

For this reason, when the timing of ejecting ink from the head 10 is adjusted, it is possible to correct the ink droplet landing position in the transport direction to be the desired ink droplet landing position.

Figure 7:
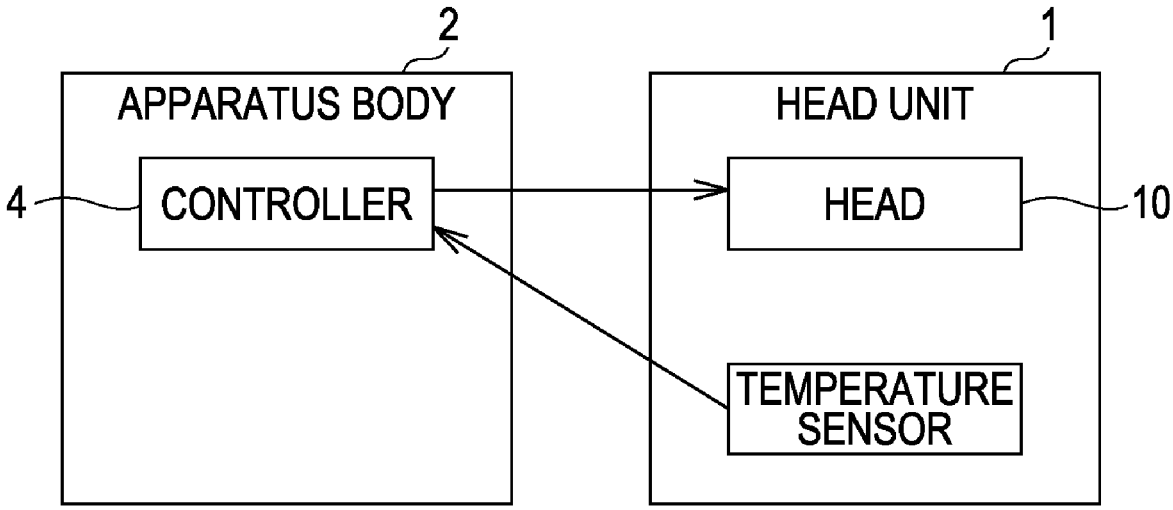
FIG. 7 is a functional block diagram illustrating the ink jet printing apparatus according to the first embodiment.

The ink ejection timing correction is performed by the controller 4 as below. As shown in FIG. 7, the head 10 is provided with a temperature sensor (temperature measuring unit) which measures a temperature of the base plate 20, and a signal showing the temperature of the base plate 20 measured by the temperature sensor is transmitted to the controller 4.

Meanwhile, the controller 4 corrects the ink ejection timing in accordance with the temperature. The controller 4 corrects the timing of transmitting the driving signal on the basis of the printing data in accordance with the temperature obtained by the temperature sensor, and transmits the driving signal to the head 10 at the corrected timing so as to eject ink from the head 10.

Figure 8A:
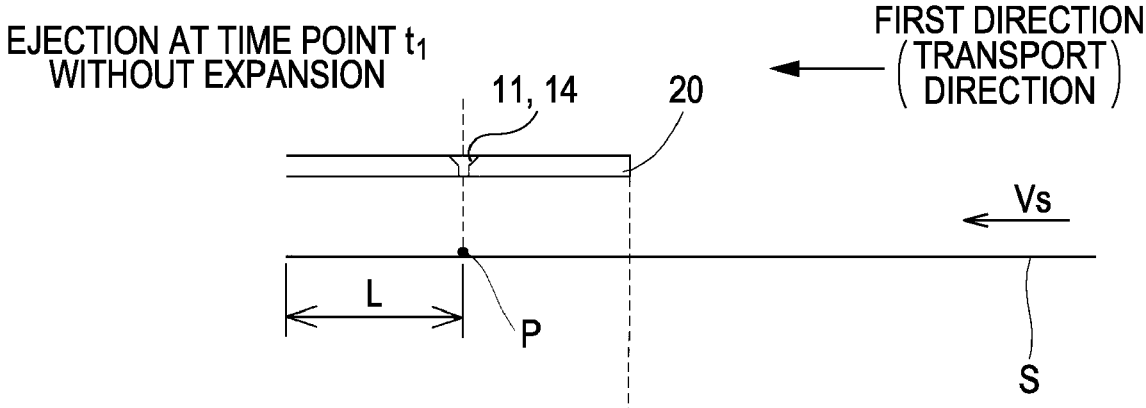
FIGS. 8A, 8B, and 8C are conceptual diagrams illustrating an ink ejection timing correction of a controller according to the first embodiment.
Figure 8B:
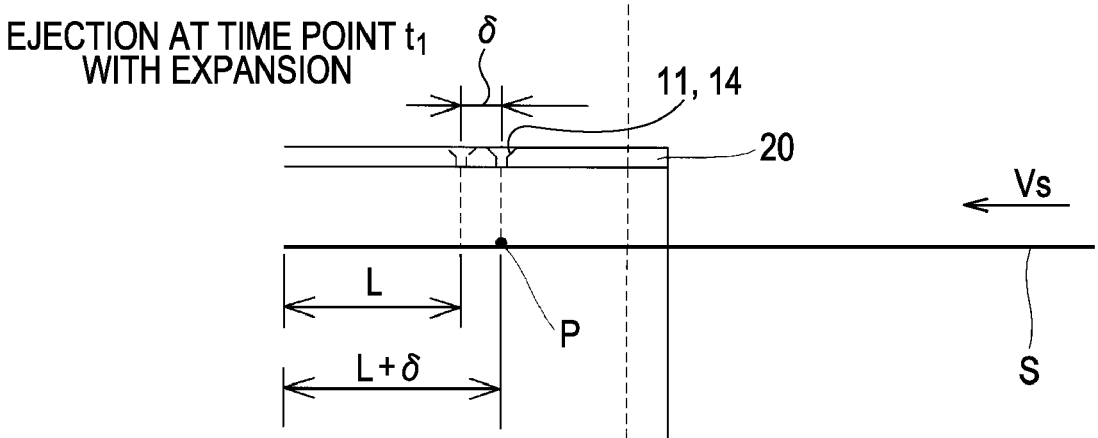

For example, in the case where there is no expansion as shown in FIG. 8A, when the driving signal is transmitted at the time point $t_1$, an ink droplet P is landed on a position distant by a distance L from one end of the printing sheet S transported at a speed Vs. Meanwhile, in the case where the base plate 20 is expanded by the expansion amount δ in the transport direction as shown in FIG. 8B, when the driving signal is transmitted at the time point $t_1$ as in the case of no expansion, the ink droplet P is landed on a position distant by a distance L+δ from one end of the printing sheet S.

Figure 8C:
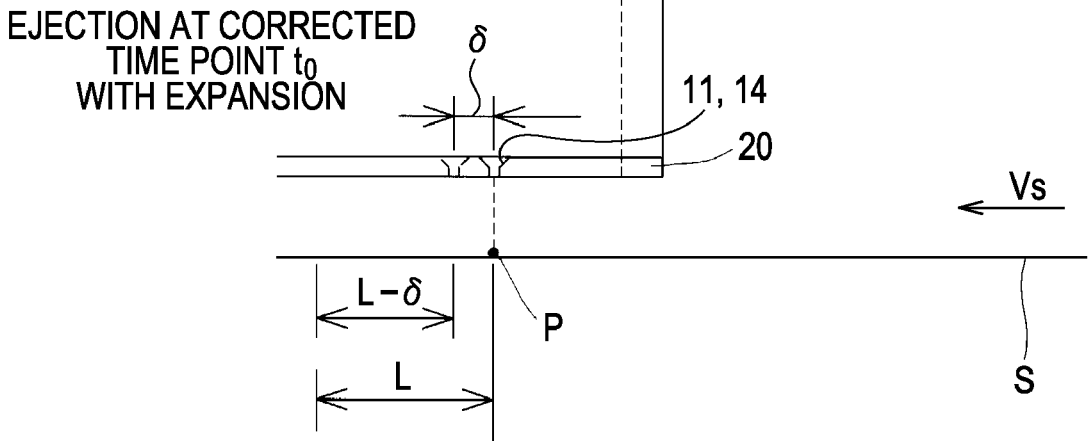

However, when the controller 4 corrects the time point $t_1$ and transmits the driving signal at the time point $t_0$ ($t_0<t_1$) as shown in FIG. 8C, the ink droplet P is landed on a position distant by a distance L (=L−δ+δ) from one end of the printing sheet S, that is, a position based on the printing data.

The ink ejection timing may be corrected by various methods. However, for example, since the linear expansion coefficient of the base plate 20 is given by the material thereof, the expansion amount δ is obtained from the temperature of the base plate 20. Accordingly, the driving signal is transmitted to the head 10 at the corrected ejection timing corresponding to the timing ($t_0$) at which the ink is landed on a position distant by a distance L−δ from one end of the printing sheet S.

As described above, in the ink jet printing apparatus I including the head unit 1 according to this embodiment, since the linear expansion coefficient of the base plate 20 in the regulation direction (second direction) is smaller than that in the transport direction (first direction), it is possible to reduce the deviation of the ink droplet landing position in the regulation direction. Accordingly, it is possible to reduce or ignore the influence thereof. In addition, since the base plate 20 is easily expanded in the transport direction, even when the ink droplet landing position on the printing sheet S is deviated, the ink droplet can be landed on an extension line extending from the desired ink droplet landing position along the transport direction. Accordingly, it is possible to easily correct the deviation by adjusting the ink ejection timing of the controller 4. As a result, since it is possible to reduce an error in ink droplet landing position caused by the expansion of the base plate, it is possible to provide the ink jet printing apparatus I capable of improving the printing quality.

In this embodiment, since the frame member 30 is provided so as to regulate the expansion of the base plate 20 in the regulation direction and the sandwiching portion 40 is provided so as to regulate the expansion of the base plate 20 in the ink ejection direction, the base plate 20 is substantially expanded in the transport direction. For this reason, since it is possible to correct the ink droplet landing position in the transport direction by correcting the ink ejection timing of the controller 4, it is possible to improve the precision of the ink droplet landing position.

In addition, since the respective heads 10 are commonly provided in the base plate 20, in the positional deviation of each of the heads 10 due to the expansion of the base plate 20, the total heads 10 have the same positional deviation. For this reason, the ink ejection timing correction of the controller 4 may be simultaneously performed in all heads 10.

In this embodiment, the head unit 1 is fixed to the apparatus body 2, and the printing sheet S is transported in the transport direction. However, the printing sheet S may be fixed, and the head unit 1 may be moved in the transport direction.

Second Embodiment

Figure 9A:
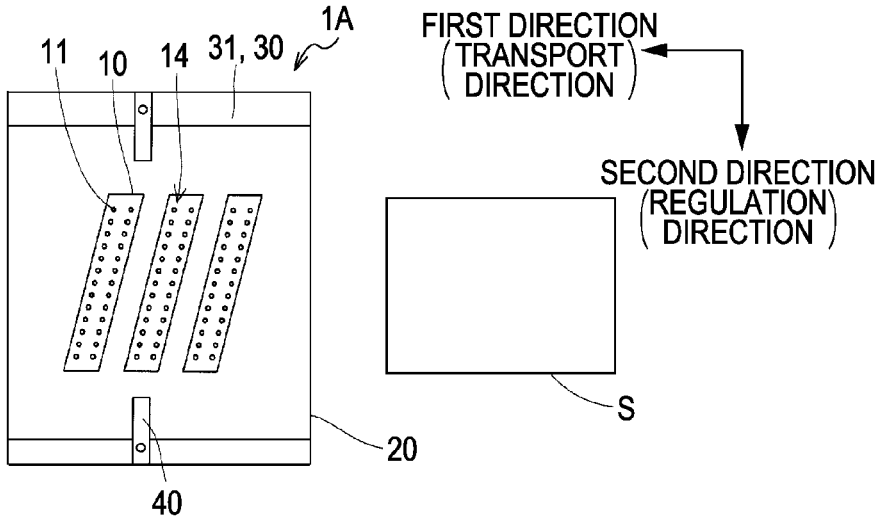
FIGS. 9A, 9B, and 9C are plan views illustrating the ink jet printing head unit according to a second embodiment.
Figure 9B:
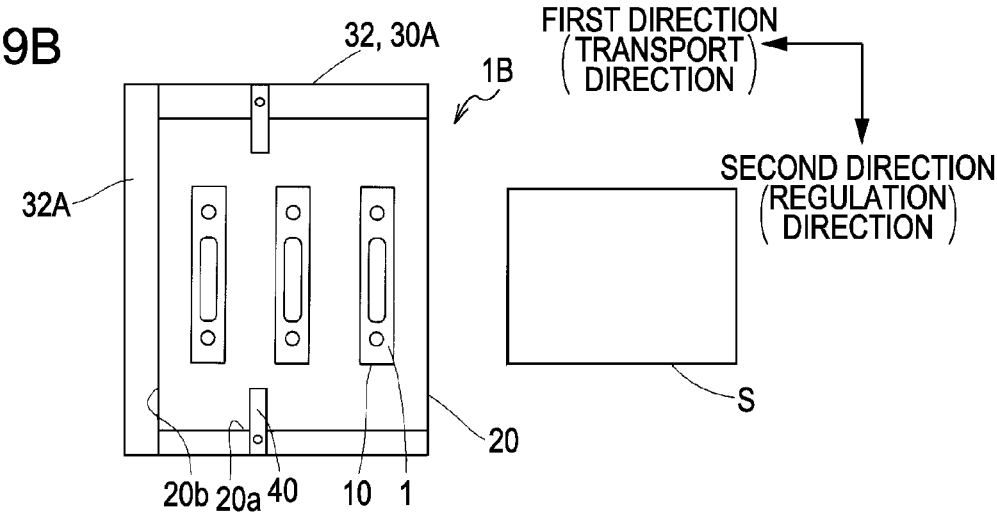
Figure 9C:
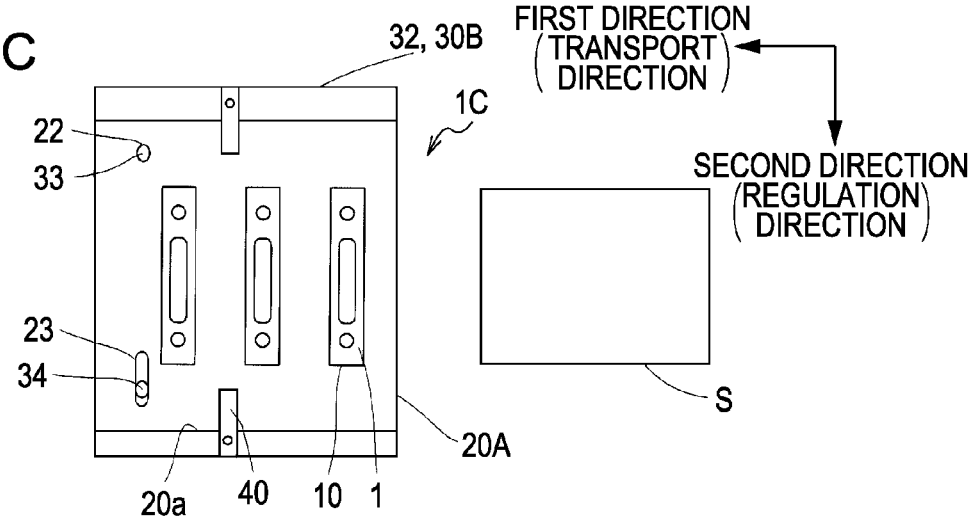

FIGS. 9A, 9B, and 9C illustrate the ink jet printing head unit according to a modified example of the invention. In addition, the same reference numerals will be given to the same constituents as those of the first embodiment, and the description thereof will be omitted.

FIG. 9A illustrates an ejection surface of a head unit 1A. As shown in FIG. 9A, the head unit 1A retains the heads 10 which are not perpendicular to the transport direction (first direction) of the printing sheet S, but is inclined relative thereto. In short, the regulation direction may be a direction perpendicular to the transport direction regardless of the directions of the nozzle rows 14.

Even in the head unit 1A, since the linear expansion coefficient of the base plate 20 in the regulation direction (second direction) is shorter than that in the transport direction (first direction), the base plate 20 is hardly expanded in the regulation direction, and the frame members 30 further regulate the expansion of the base plate 20 in the regulation direction. Accordingly, the base plate 20 is substantially expanded in the transport direction. For this reason, in the head unit 1A, the deviation of the ink droplet landing position in the regulation direction is small, and the deviation of the ink droplet landing position in the transport direction is easily corrected by correcting the ink ejection timing of the controller 4 (FIG. 7).

In addition, when the heads 10 are arranged so that the nozzle rows 14 are obliquely inclined relative to the transported printing sheet S, since an actual gap between the nozzles 11 is narrowed relative to the printing sheet S, it is possible to perform a highly precise printing operation.

FIG. 9B illustrates a retaining surface of a head unit 1B. As shown in FIG. 9B, a frame member 30A provided in the head unit 1B is further provided with a regulation portion 32A which faces a side surface 20*b* of one end of the base plate 20 in the transport direction. Accordingly, since the expansion of the base plate 20 toward the one end is regulated by the regulation portion 32A, the base plate 20 is expanded toward the other end. In the head unit 1B, the expansion of the base plate 20 is generated only toward the other end. Also, it is possible to more highly precisely calculate the expansion amount δ toward the other end by using the controller 4, and to improve the precision in the ejection timing correction.

Further, FIG. 9C illustrates a retaining surface of a head unit 1C. As shown in FIG. 9C, the base portion 31 (see FIG. 4) of a frame member 30B is provided with positioning pins 33 and 34 which are formed upright, and a base plate 20A is provided with a positioning hole 22 and an elongate positioning hole 23 through which the positioning pins 33 and 34 are inserted. The positioning pins 33 and 34 are disposed in the base portion 31 so that the base plate 20A is retained at a predetermined position of the frame member 30B. When the positioning pin 33 is inserted through the positioning hole 22, the position of the base plate 20A with respect to the frame member 30B is determined. When the positioning pin 34 is inserted through the elongate positioning hole 23, the rotary angle of the base plate 20A is determined.

Since the positioning pins 33 and 34 are provided, it is possible to position the base plate 20A to the frame member 30B. In addition, since the positioning pins 33 and 34 are disposed in one end of the base plate 20A in the transport direction, it is possible to regulate the expansion of the base plate 20A toward the one end. In this case, the base plate 20A is expanded toward the other end. In the head unit 1C, the expansion of the base plate 20A is generated only toward the other end. Accordingly, it is possible to more highly precisely calculate the expansion amount δ toward the other end by using the controller 4, and to improve the precision in the ejection timing correction.

Other Embodiments

While the exemplary embodiments of the invention have been described as above, the basic configuration of the invention is not limited to the above description.

In the ink jet printing apparatus I according to the first and second embodiments, the head unit 1 is fixed to the apparatus body 2, but the invention is not limited thereto. That is, the head unit 1 may be movable in a direction intersecting the transport direction of the printing sheet S. For example, an ink jet printing apparatus may be provided in which a transport shaft is disposed in a direction intersecting the transport direction of the printing sheet S, the head unit is disposed so as to be movable along the transport shaft, and then a driving force of a driving motor is transmitted to the head unit through a timing belt or the like so as to move the head unit along the transport shaft.

In this case, a direction in which an ink droplet is ejected while the head unit 1 moves, that is, a moving direction along the transport shaft corresponds to a first direction. A direction perpendicular to the first direction, that is, a direction in which the printing sheet S is transported corresponds to a second direction.

Even in the ink jet printing apparatus, the linear expansion coefficient of the base plate in the second direction is smaller than that in the first direction, and the expansion of the base plate is regulated in the second direction by the regulation portion or the sandwiching portion of the frame member. For this reason, even when the base plate is expanded in accordance with an environmental temperature, since the base plate is hardly expanded or contracted or is expanded or contracted by an ignorable amount in the second direction, it is possible to reduce an error in the precision of the ink droplet landing position in the regulation direction. In addition, since the base plate is substantially expanded in the transport direction, even when the ink droplet landing position is deviated due to the expansion, the ink droplet is landed on an extension line extending along the transport direction from the desired ink droplet landing position. Accordingly, it is possible to easily correct the precision of the ink droplet landing position in the transport direction by correcting the ink ejection timing, at which the ink is ejected from the head 10, so as to be earlier or later than the current ink ejection timing.

In the first and second embodiments, the respective heads 10 are commonly provided in the base plates 20 and 20A, but each of the heads 10 may be retained in the separate base plate.

In the first and second embodiments, each of the heads 10 is provided with two rows of nozzle rows 14, but the invention is not particularly limited thereto. For example, each of the heads 10 may be provided with one row of nozzle row 14 or three rows or more of nozzle rows 14.

In the first and second embodiments, the head group 100 includes two heads 10, but the invention is not limited thereto. For example, the head group 100 may include one or more heads 10.

In the first and second embodiments, the head unit 1 is provided with four head groups 100, but the invention is not limited thereto. The number of the head groups 100 may be one or two or more.

Of course, the number of the head units 1 mounted to the liquid ejecting apparatus is not particularly limited, and plural head units 1 may be mounted to the liquid ejecting apparatus.

Further, the invention is applied to a wide variety of liquid ejecting heads, and may be applied to, for example, a printing head such as various ink jet printing heads used in an image printing apparatus such as a printer, a color material ejecting head used to manufacture a color filter such as a liquid crystal display, an electrode material ejecting head used to form an electrode of an organic EL display, an FED (field emission display), and the like, and a biological organic material ejecting head used to manufacture a bio chip. In addition, as an example of the liquid ejecting apparatus, the ink jet printing apparatus I is exemplified, but the above-described other liquid ejecting heads may be applied to the liquid ejecting apparatus.

What is claimed is:

1. A liquid ejecting head unit comprising:

a liquid ejecting head which includes a nozzle row formed by nozzles arranged in series so as to eject a liquid onto a printing medium;

a base plate which retains the liquid ejecting head; and a regulation member which includes regulation portions facing side surfaces of both ends of the base plate in the second direction and regulates expansion of the base plate in the second direction;

wherein a linear expansion coefficient of the base plate in a first direction as a relative moving direction between the printing medium and the liquid ejecting head is larger than that in a second direction perpendicular to the first direction.

2. The liquid ejecting head unit according to claim 1, wherein the regulation member includes a sandwiching portion which sandwiches the base plate in a liquid ejection direction of the liquid ejecting head, and regulates expansion of the base plate in the liquid ejection direction.

3. The liquid ejecting head unit according to claim 1, wherein a plurality of the liquid ejecting heads is disposed in one base plate.

4. A liquid ejecting apparatus comprising:

a liquid ejecting head which includes a nozzle row formed by nozzles arranged in series so as to eject a liquid onto a printing medium;

a base plate which retains the liquid ejecting head, wherein a linear expansion coefficient of the base plate in a first direction as a relative moving direction between the printing medium and the liquid ejecting head is larger than that in a second direction perpendicular to the first direction;

a moving mechanism which relatively moves the liquid ejecting head unit and the printing medium in the first direction;

a controller which transmits a driving signal to the liquid ejecting head so as to eject a liquid therefrom; and an apparatus body.

5. The liquid ejecting apparatus according to claim 4, wherein the liquid ejecting head unit is fixed to the apparatus body, and wherein the moving mechanism transports the printing medium to the liquid ejecting head unit along the first direction.

6. The liquid ejecting apparatus according to claim 4, wherein the liquid ejecting head unit is provided in the apparatus body so as to be movable in the first direction, and wherein the moving mechanism transports the printing medium to the liquid ejecting head unit along the second direction.

7. The liquid ejecting apparatus according to claim 4, further comprising:

a temperature measuring unit which measures a temperature of the base plate, wherein the controller corrects a liquid droplet ejection timing on the basis of the temperature measured by the temperature measuring unit, and transmits the driving signal to the liquid ejecting head at the corrected liquid droplet ejecting timing.

* * * * *